US009890799B2

(12) United States Patent
Gomm et al.

(10) Patent No.: US 9,890,799 B2
(45) Date of Patent: Feb. 13, 2018

(54) METHOD TO DETECT HYDRAULIC VALVE FAILURE IN HYDRAULIC SYSTEM

(71) Applicant: Parker-Hannifin Corporation, Cleveland, OH (US)

(72) Inventors: Ralf Gomm, Charlotte, NC (US); Christian Josefsson, Sandhult (SE)

(73) Assignee: Parker-Hannifin Corporation, Cleveland, OH (US)

( * ) Notice: Subject to any disclaimer, the term of this patent is extended or adjusted under 35 U.S.C. 154(b) by 85 days.

(21) Appl. No.: 14/785,520

(22) PCT Filed: Apr. 21, 2014

(86) PCT No.: PCT/US2014/034797
§ 371 (c)(1),
(2) Date: Oct. 19, 2015

(87) PCT Pub. No.: WO2014/172704
PCT Pub. Date: Oct. 23, 2014

(65) Prior Publication Data

US 2016/0084271 A1 Mar. 24, 2016

Related U.S. Application Data

(60) Provisional application No. 61/813,964, filed on Apr. 19, 2013.

(51) Int. Cl.
*F15B 20/00* (2006.01)
*F15B 11/00* (2006.01)

(52) U.S. Cl.
CPC ..... *F15B 11/003* (2013.01); *F15B 20/008* (2013.01); *F15B 2211/20515* (2013.01);
(Continued)

(58) Field of Classification Search
CPC ..... F15B 20/008
See application file for complete search history.

(56) References Cited

U.S. PATENT DOCUMENTS 6,269,635 B1 8/2001 Zuehlke
6,912,849 B2 7/2005 Inoue et al.
(Continued)

FOREIGN PATENT DOCUMENTS

AT 6 861 U1 5/2004
EP 2 318 720 A1 5/2011
(Continued)

OTHER PUBLICATIONS

International Preliminarily Report on Patentability for corresponding Patent Application No. PCT/US2014/034797 dated Oct. 29, 2015.
(Continued)

*Primary Examiner* — F. Daniel Lopez
(74) *Attorney, Agent, or Firm* — Renner, Otto, Boisselle & Sklar, LLP

(57) ABSTRACT

According to one aspect of the invention, a hydraulic system includes a controller connected to an operator interface, a pump operable in a first direction for supplying pressurized fluid, and a load-holding valve connected between the pump and a port for connection to an actuator. The load-holding valve may be controlled by the controller and operative in a first position to allow flow to the actuator to operate the actuator against a load and operative in a second position to block load-induced return flow from the actuator to the pump. The controller may be configured to receive a requested actuator stop, to control the first valve to move to the second position in response to the requested actuator stop, to monitor a first system condition in response to the requested actuator stop, to evaluate the monitored system condition with a prescribed criteria, and to determine
(Continued)

whether or not to initiate a back-up control routine based on the evaluation.

18 Claims, 6 Drawing Sheets

(52) U.S. Cl.
CPC . *F15B 2211/20561* (2013.01); *F15B 2211/27* (2013.01); *F15B 2211/30515* (2013.01); *F15B 2211/633* (2013.01); *F15B 2211/6309* (2013.01); *F15B 2211/6313* (2013.01); *F15B 2211/6346* (2013.01); *F15B 2211/6651* (2013.01); *F15B 2211/8636* (2013.01)

(56) References Cited

U.S. PATENT DOCUMENTS

| | | | | |
|---|---|---|---|---|
| 7,069,673 | B2 | 7/2006 | Kagoshima et al. | |
| 2003/0010198 | A1* | 1/2003 | Fuss | F15B 20/008 92/5 R |
| 2008/0292474 | A1 | 11/2008 | Vigholm et al. | |
| 2008/0294316 | A1 | 11/2008 | Vigholm et al. | |
| 2008/0295504 | A1 | 12/2008 | Vigholm et al. | |
| 2008/0295505 | A1 | 12/2008 | Vigholm et al. | |
| 2008/0302099 | A1 | 12/2008 | Vigholm et al. | |
| 2009/0287373 | A1 | 11/2009 | Vigholm et al. | |
| 2010/0313849 | A1 | 12/2010 | Stoner et al. | |
| 2011/0030364 | A1 | 2/2011 | Persson et al. | |
| 2011/0208363 | A1 | 8/2011 | Vanderlaan et al. | |
| 2011/0209471 | A1 | 9/2011 | Vanderlaan et al. | |
| 2012/0221212 | A1 | 8/2012 | Peterson et al. | |

FOREIGN PATENT DOCUMENTS

| | | |
|---|---|---|
| WO | 01/59307 A1 | 8/2001 |
| WO | 2006/088399 | 8/2006 |
| WO | 2012/046677 | 4/2012 |

OTHER PUBLICATIONS

International Search Report and Written Opinion for corresponding Patent Application No. PCT/US2014/034797 dated Aug. 19, 2014.

* cited by examiner

METHOD TO DETECT HYDRAULIC VALVE FAILURE IN HYDRAULIC SYSTEM

RELATED APPLICATIONS

This application is a national phase of international Application No. PCT/US2014/034797 filed on Apr. 21, 2014 and published in the English language, which claims the benefit of U.S. Provisional Application No. 61/813,964 filed Apr. 19, 2013, all of which are hereby incorporated herein by reference.

FIELD OF INVENTION

The present invention relates generally to electro-hydrostatic actuator systems, and more particularly to control algorithms for control of such machines.

BACKGROUND

It is common for a work machine such as but not limited to hydraulic excavators, wheel loaders, loading shovels, backhoe shovels, mining equipment, industrial machinery and the like, to have one or more actuated components such as lifting and/or tilting arms, booms, buckets, steering and turning functions, traveling means, etc. Commonly, in such machines, a prime mover drives a hydraulic pump for providing fluid to the actuators. Open-center or closed-center valves control the flow of fluid to the actuators.

Some modern machines have replaced the traditional hydraulic system described above with an electro-hydrostatic actuator system (EHA). An electro-hydrostatic actuator includes a reversible, variable speed electric motor that is connected to a hydraulic pump, generally fixed displacement, for providing fluid to an actuator for controlling motion of the actuator. The speed and direction of the electric motor controls the flow of fluid to the actuator. Power for the electric motor is received from a power unit, for example a generator, a power storage unit, such as a battery, or both. At, for example, deceleration and/or lowering motion of a load, the power unit may receive power from the said electric motor that is then operated as a generator. A system that includes an electro-hydrostatic actuator is referred to herein as an electro-hydrostatic actuator system.

SUMMARY OF INVENTION

When the load holding valve is closed to hold a load, the pressure between the actuator holding the load and the load holding valve will remain, but the pressure between valve and pump should reduce quickly due to pump leakage in an electro-hydraulic system in which the pump is not being operated to supply pressure. However, if instead the load torque at the pump/electric motor/inverter remains present, this indicates that the pressure has not decreased and that the load holding valve has failed to close fully or at all. In such case, exemplary systems still allow the load to be lowered in a controlled fashion and a warning may be issued to the operator.

According to one aspect of the invention, a hydraulic system includes a controller connected to an operator interface; a pump operable in a first direction for supplying pressurized fluid; and a load-holding valve connected between the pump and a port for connection to an actuator. The load-holding valve may be controlled by the controller and operative in a first position to allow flow to the actuator to operate the actuator against a load and operative in a second position to block load-induced return flow from the actuator to the pump. The controller may be configured to receive a requested actuator stop, to control the first valve to move to the second position in response to the requested actuator stop, to monitor a first system condition in response to the requested actuator stop, to evaluate the monitored system condition with a prescribed criteria, and to determine whether or not to initiate a back-up control routine based on the evaluation.

Optionally, the back-up routine includes operating the pump to control load-induced movement of the actuator.

Optionally, the controller is further configured to generate an alert indicating failure of the first valve.

Optionally, the controller is further configured to run the pump to depressurize hydraulic fluid between the pump and the first valve after the first valve is controlled to close.

Optionally, the hydraulic system further includes a second valve selectively fluidly connecting a hydraulic passage between the pump and the first valve to a reservoir. The controller may be further configured to connect the fluid passage to the reservoir after the first valve is controlled to close.

Optionally, the pump is a bi-directional pump operable in a first direction for supplying pressurized fluid through the first valve to the hydraulic actuator for operating the actuator in one direction, and operable in a second direction opposite the first direction for supplying pressurized fluid through a second valve to the hydraulic actuator for operating the actuator in a direction opposite the first direction.

Optionally, the hydraulic system may further include a hydraulic actuator to and from which hydraulic fluid is supplied and returned in opposite directions to operate the actuator in opposite directions.

Optionally, the hydraulic system may further include a boost system for accepting fluid from or supplying fluid to a hydraulic circuit of the hydraulic system. The boost system may include a boost pump for supplying fluid to a fluid make-up/return line that selectively is in fluid communication with the hydraulic actuator, and a boost electric machine for driving the boost pump, the electric machine connected to a boost electric power source through a boost inverter.

Optionally, the hydraulic system may include an electric machine operated by the controller and connected to an electrical source through an inverter to drive the pump.

Optionally, the monitored system condition is pressure between the pump and the first valve.

Optionally, the monitored system condition is electric machine torque.

According to another aspect of the invention, a method of detecting a failure of hydraulic valve configured to control flow between a pump and an actuator in a hydraulic system may include the steps of receiving a requested stop of the actuator; controlling the valve to close in response to the requested stop of the actuator; monitoring a first system condition in response to the requested stop of the actuator; evaluating the monitored system condition with a prescribed criteria; and determining whether or not the valve has failed based on the evaluation.

Optionally, the method may further include determining whether or not to operate the pump to stop the actuator based on the evaluation.

Optionally, monitoring a first system condition includes monitoring pressure between the pump and the valve.

Optionally, monitoring a first system condition includes monitoring electric machine torque, wherein the electric machine operated the pump.

Optionally, the method may further include operating the pump to reduce pressure between the pump and the hydraulic valve after the controlling.

Optionally, the method may further include opening a bleed valve to reduce pressure between the pump and the hydraulic valve after the controlling.

Optionally, the method may further include operating the pump in one direction for supplying pressurized fluid through the valve to the hydraulic actuator for operating the actuator in a first direction, and operating the pump in a second direction opposite the first direction for supplying pressurized fluid through a second valve to the hydraulic actuator for operating the actuator in a direction opposite the first direction.

Optionally, the method may further include driving the pump via an electric machine connected to an electrical source through an inverter.

Optionally, the method may further include generating an alert indicating failure of the hydraulic valve based on the determination.

The foregoing and other features of the invention are hereinafter described in greater detail with reference to the accompanying drawings.

DETAILED DESCRIPTION

Exemplary embodiments of the invention relate generally to hydraulic actuation systems for extending and retracting at least one asymmetric hydraulic cylinder in a work machine, such as but not limited to hydraulic excavators, wheel loaders, loading shovels, backhoe shovels, mining equipment, industrial machinery and the like, having one or more actuated components such as lifting and/or tilting arms, booms, buckets, steering and turning functions, traveling means, etc.

When a load holding valve is commanded open, the pump/electric motor inverter will experience a load torque representing hydraulic cylinder pressure. When the load holding valve is commanded to close by a controller, the pressure between cylinder and valve will remain but the pressure between valve and pump should reduce quickly due to pump leakage. However, if instead the load torque at the pump/electric motor inverter remains present, this indicates that the load holding valve has failed to close. In such case, exemplary systems still allow the load to be lowered in a controlled fashion and a warning may be issued to the operator.

Figure 1:
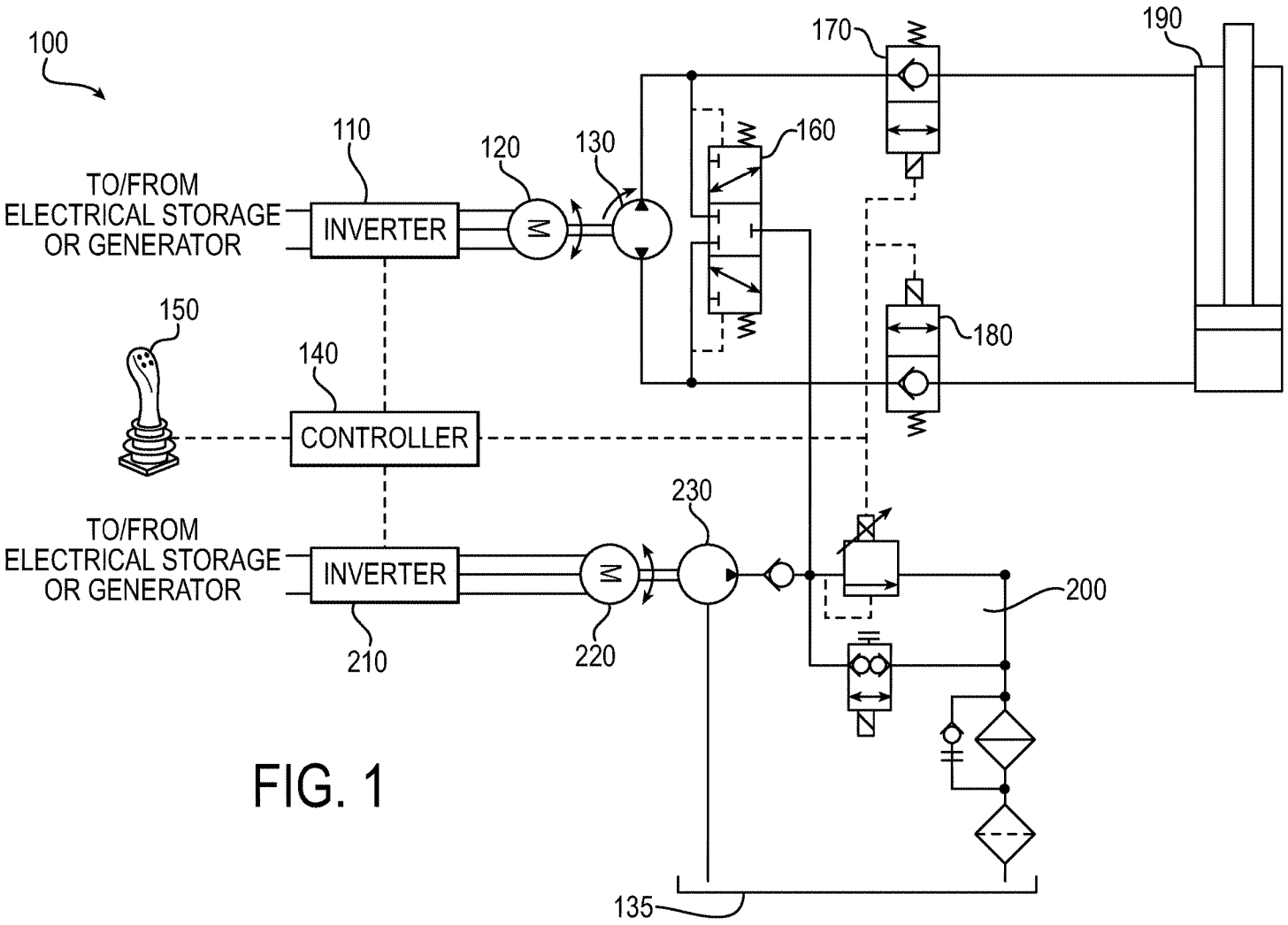
FIG. 1 illustrates an exemplary schematic electro-hydrostatic actuator system.

Referring in detail to FIG. 1, an exemplary embodiment of an electro-hydrostatic actuator system 100 is shown. The system includes at least one actuator 190 to be mechanically connected to a work machine and hydraulically connected to the system 100.

An inverter 110 may be connected to an electrical energy source or energy unit such as an electrical storage (e.g., one or more batteries) or a generator and controls an electric machine 120 (e.g., an electric motor) in bi-directional speed or torque control mode. The electric machine 120 may be mechanically coupled to and drive a hydraulic pump 130, which may be any appropriate type, but is generally a fixed displacement, variable speed pump. The inverter may also store energy generated by the electrical machine in the storage when the pump is back-driven by hydraulic fluid, for example, during a down motion of the actuator when under an external load.

The operator of the system may command a desired actuator speed or force through an input device such as a joystick 150 connected to a controller 140. In other embodiments, a separate command controller may generate the command signal that is passed to the controller 140, for example if the work machine is being remotely or autonomously controlled.

The controller 140 issues commands to the inverter 110 which in conjunction with the motor 120 and pump 130 allows generation of bi-directional flow and pressure via the hydraulic pump 130. The flow is then directed through load holding valves 170, 180 to the actuator 190 yielding the desired actuator motion.

FIG. 1 shows the load holding valves 170, 180 as being ON/OFF type valves, however either or both of these valves could also be flow-control valves, orifice valves or any other proportionally adjustable valve. Exemplary valves are poppet valves so as to prevent leakage through the valves when the valves are closed.

Because most mobile machinery uses un-balanced actuators with a large and small volume chamber, a flow management system 200, for example as presented in U.S. Patent Application Publication No. 2011/0030364 A1 (incorporated herein by reference), controlled by a second inverter 210 and second electric machine 220 and second hydraulic pump 230, provides whatever input flow required by the actuator pump 130 via the shuttle valve 160.

During an actuator extend motion to lift a load, the actuator pump 130 provides flow into the large volume of the actuator 190 (the piston side) and the flow management system 200 is connected to the actuator pump inlet via the shuttle valve 160, ensuring that the flow difference of large volume minus small volume (the rod side) is provided to the actuator pump 130.

During an actuator retraction motion to lower a load, the actuator pump 130 consumes flow from the large volume of the actuator 190 and the flow management system 200 is connected to the actuator pump outlet via the shuttle valve 160, diverting excess flow of large volume minus small volume back to the flow management system 200 and ultimately to the hydraulic reservoir 135.

Although the actuator depicted is a cylinder, it is contemplated that other actuators are possible. Further, the orientation of the cylinder may be reversed from that which is shown.

In general, when the operator does not command an actuator motion, both load holding valves 170, 180 may be closed to remove the hydraulic load from the pump, reduce consumption of electrical energy and prevent the load from dropping in case the pump drive source is turned off. This may cause the pressure between the load holding valves and pump to decay over time, largely due to leakage in the pump. The pressure between the load holding valves and actuator, however, remains at a level to support the external load without actuator motion.

Figure 2:
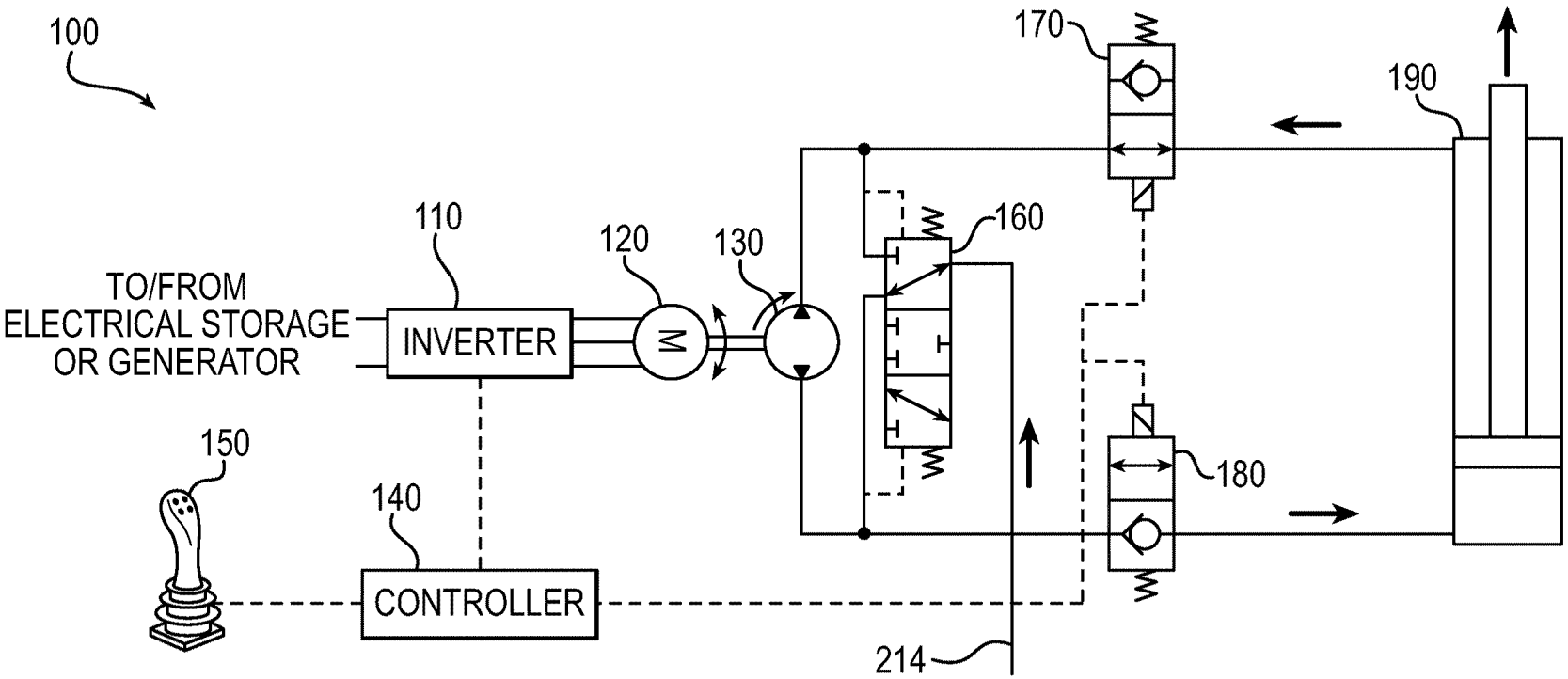
FIG. 2 illustrates an exemplary, simplified schematic embodiment of a system showing an actuator extension motion, direction of fluid flow indicated by arrows and load holding valve states to enable this motion.

Referring now in detail to FIG. 2, an exemplary embodiment of an electro-hydrostatic actuator system 100 is shown. The system is the same as that shown in FIG. 1, except that the flow management system 200 is hidden to focus on operation of the remaining system. Hydraulic connection 214 indicates the to/from connection to the flow management system 200 shown in FIG. 1.

Referring back to FIG. 2, the hydraulic actuator 190 is mechanically connected to a work machine and the arrow above the actuator is used to indicate the direction of motion: extension of the actuator. The remaining arrows indicate hydraulic fluid flow direction in the system.

In order to enable an actuator extension motion, load holding valve 170 needs to be commanded open as indicated to allow fluid flow from the small volume of the actuator back to the electrically driven pump 130. Load holding valve 180 does not have to be commanded open in this case, since the type of valve used in this example includes a check valve that will pass flow freely from pump 130 into the large volume of the actuator.

Figure 3:
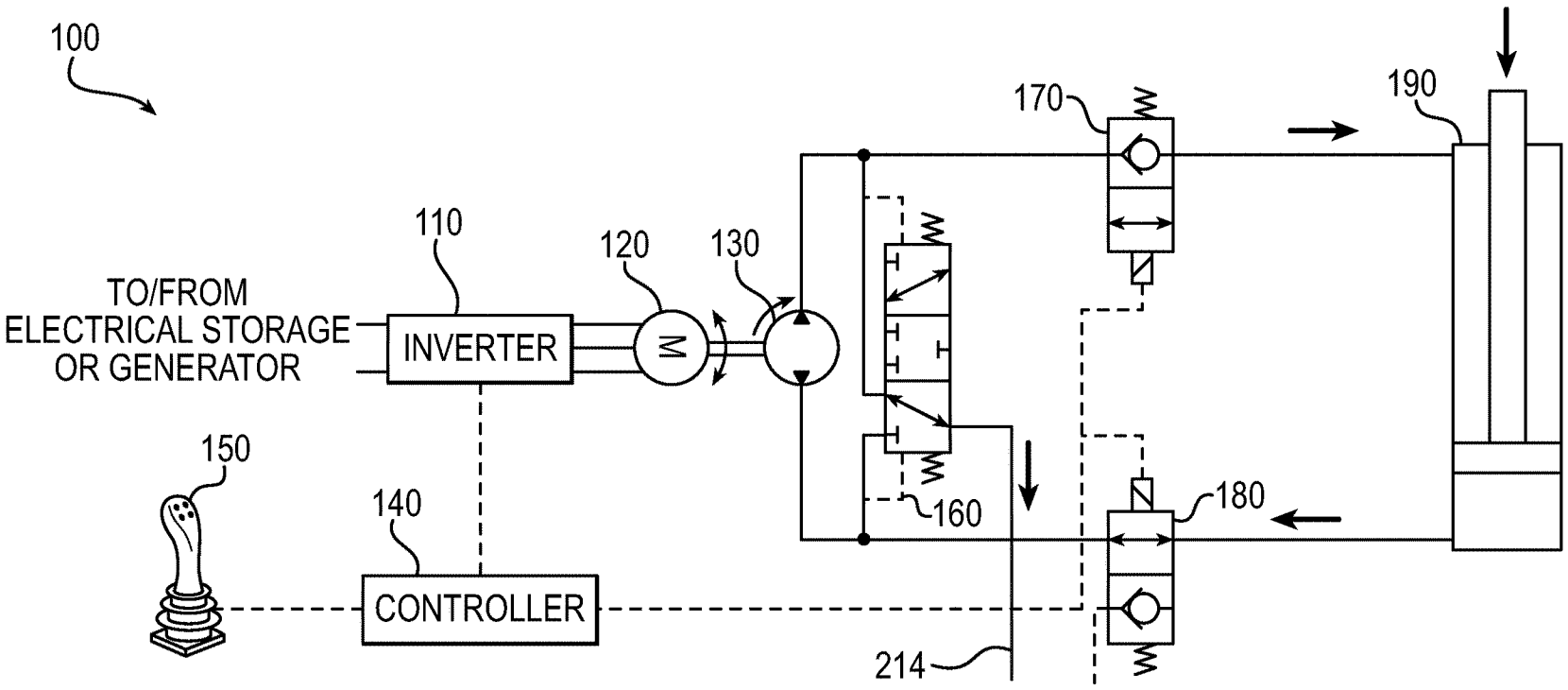
FIG. 3 illustrates an exemplary, simplified embodiment of a system showing an actuator retraction motion, direction of fluid flow indicated by arrows and load holding valve states to enable this motion.

Referring now in detail to FIG. 3, an exemplary embodiment of an electro-hydrostatic actuator system is shown. The system is the same as that shown in FIG. 1, except that the flow management system 200 is hidden to focus on operation of the remaining system. Hydraulic connection 214 indicates the to/from connection to the flow management system shown as item 200 in FIG. 1. The arrow above the actuator is used to indicate the direction of motion: retraction of the actuator.

In order to enable an actuator retraction motion, load holding valve 180 needs to be commanded open as indicated to allow fluid flow from the large volume of the actuator back to the electrically driven pump 130. Load holding valve 170 does not have to be commanded open in this case, since the type of valve used in this example includes a check valve that will pass flow freely from pump 130 into the large volume of the actuator.

Figure 4:
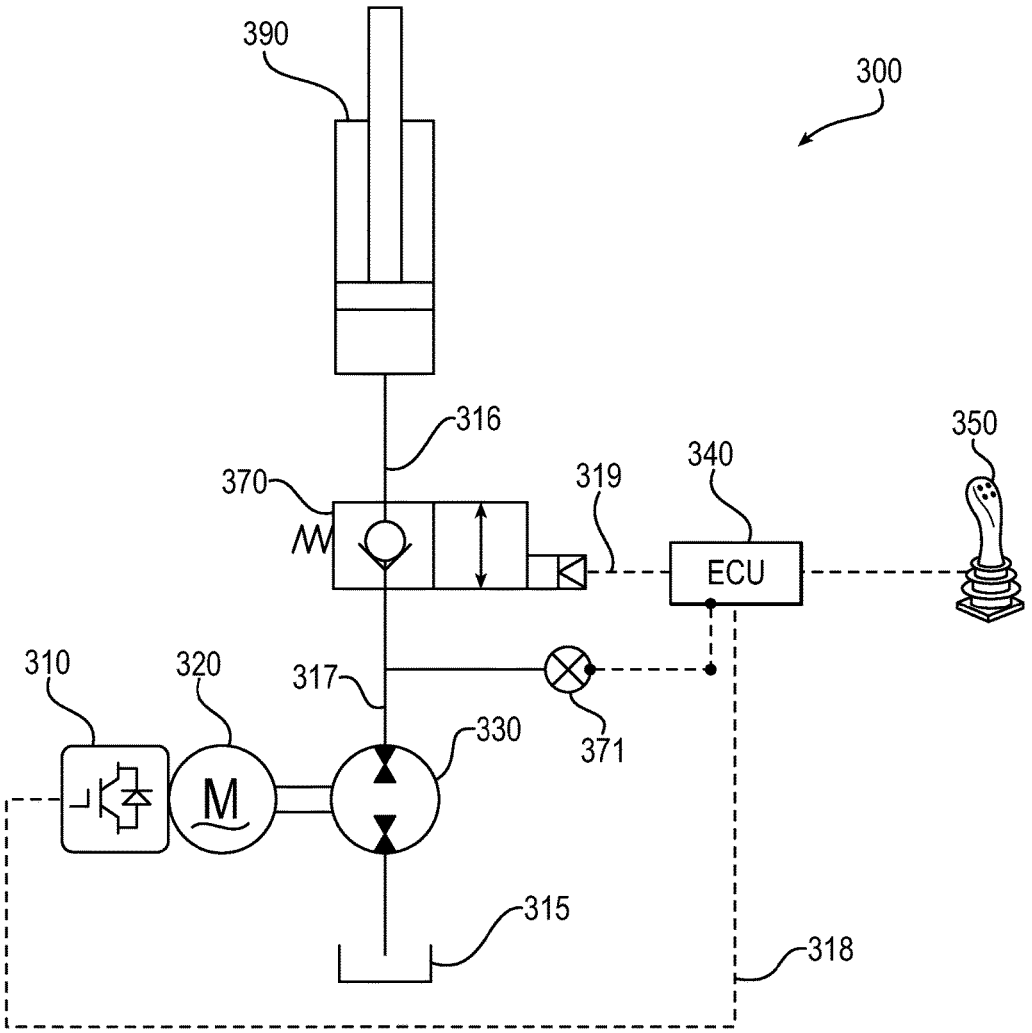
FIG. 4 illustrates a simplified exemplary embodiment of the system including an optional pressure sensor.

Referring now in detail to FIG. 4, a simplified exemplary embodiment of an electro-hydrostatic actuator system is shown at 300. The system 300 is substantially the same as the above-referenced system 100, and consequently the same reference numerals but indexed by 100 are used to denote structures corresponding to similar structures in the system. In addition, the foregoing description of the system 100 is equally applicable to the system 300 except as noted below. Moreover, it will be appreciated upon reading and understanding the specification that aspects of the systems may be substituted for one another or used in conjunction with one another where applicable.

If the load holding valve 370 is closed as shown in FIG. 4, the pressure between the load holding valves and pump 330 will decay over time, largely due to leakage in the pump, in which case the electric machine 320 will be "disconnected" from the hydraulic load and experience no or only very little torque. The pressure between the load holding valves and actuator 390 however remains at a level to support the external load without actuator motion.

Otherwise, if the load holding valve 370 is opened to support a cylinder extension motion, the electric machine 320 will be exposed or "connected" to the load.

An optional pressure sensor 371 may be included in exemplary embodiments and is shown here for example. This pressure sensor may be of any type known to those skilled in the art and may be fluidly connected between the motor and the load holding valve. This sensor may be used to directly sense pressure rather than indirectly sensing pressure via the motor torque by way of the inverter. It may optionally be used additionally to sensing motor torque to provide system redundancy.

Figure 5:
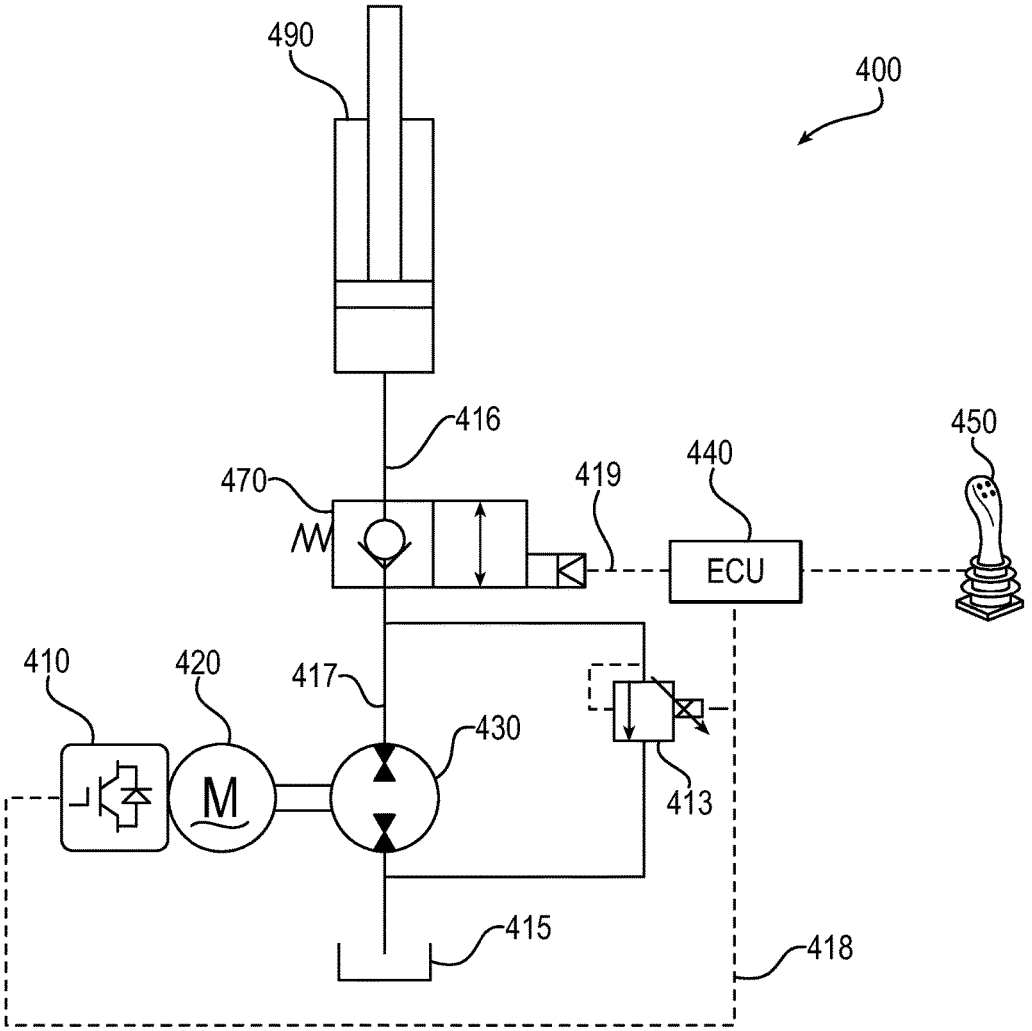
FIG. 5 illustrates another simplified exemplary embodiment of the system including an optional hydraulic fluid drain valve.

Referring now in detail to FIG. 5, a simplified exemplary embodiment of an electro-hydrostatic actuator system is shown at 400. The system 400 is substantially the same as the above-referenced systems 100 and 300, and consequently the same reference numerals but indexed by 100 are used to denote structures corresponding to similar structures in the system. In addition, the foregoing description of the systems 100 and 300 is equally applicable to the system 400 except as noted below. Moreover, it will be appreciated upon reading and understanding the specification that aspects of the systems may be substituted for one another or used in conjunction with one another where applicable.

The addition of a small valve 413 to fluid line 417 allows the pressure between the pump 430 and valve 470 to drain when the valve 470 is commanded closed. This allows for potentially faster draining of the line and, therefore, faster response time.

Figure 6:
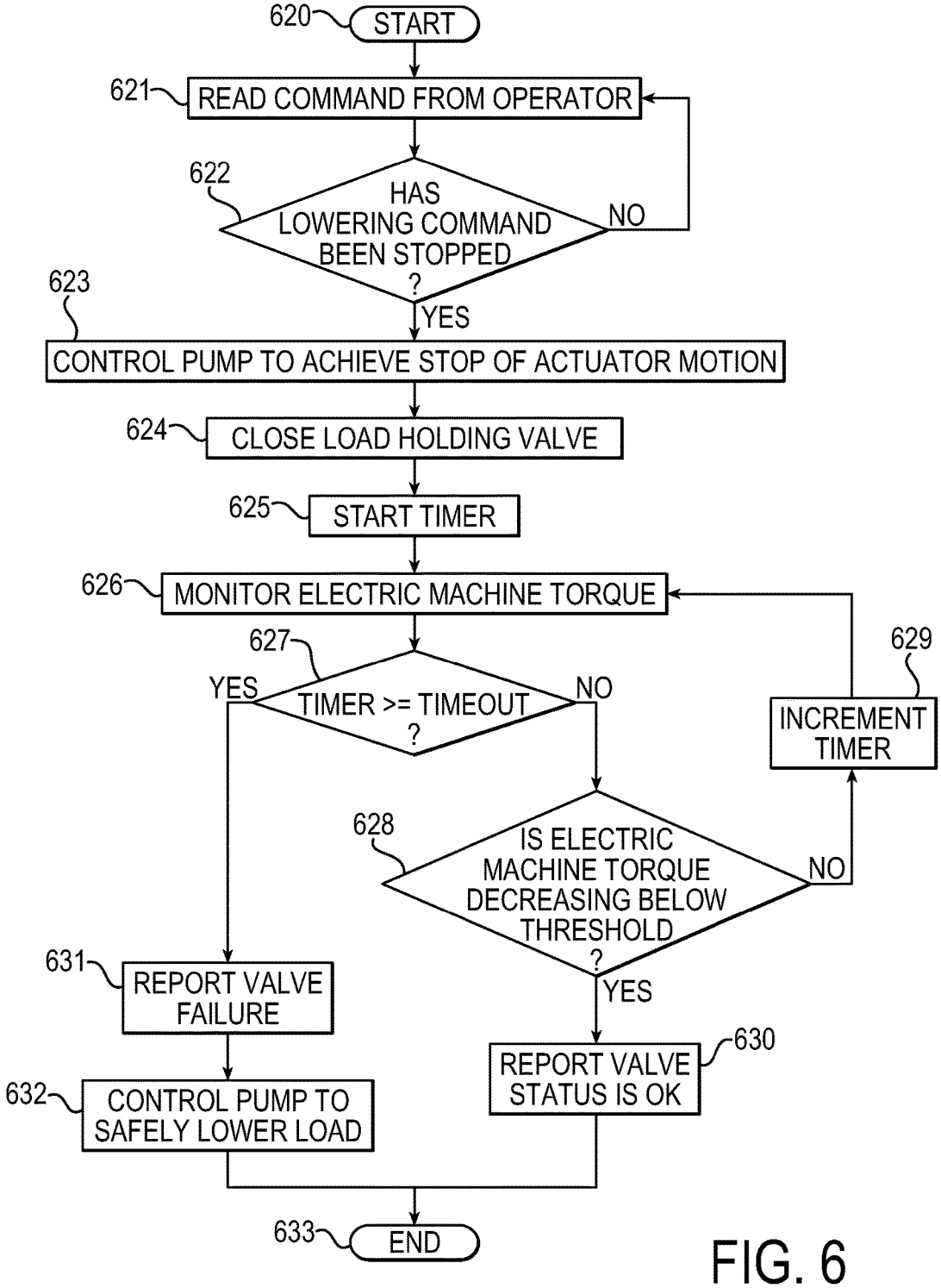
FIG. 6 illustrates an example signal control flow diagram depicting an exemplary method for lowering an actuator in an exemplary hydraulic system.

Referring now in detail to FIG. 6, a signal control flow diagram is shown to support the detailed illustration of process flow of the invention. Although discussed in reference to an "operator" or "user", it is contemplated that such method may be employed by an on-site human operator, a remote human operator, or in an autonomous or semi-autonomous mode in which an "operator command" is generated by the autonomous or semi-autonomous control program. Further, it should be understood that references to the stopping of a "lowering command" or the like encompass any command indicating a stop of the motion of an actuator being acted upon by an external force in an unbalanced manner (i.e., resulting in a net external force on the actuator).

The logic starts at the initial Start block 620.

Continuous and/or intermittent monitoring of the operator input device occurs in block 621.

The operator input may be passed along to a decision block 622 to determine if the operator has commanded a lowering motion to come to a stop. If not, the routine continues to monitor the operator input.

If a requested stop of the lowering motion is received, the pump may be controlled such that deceleration occurs and the actuator comes to a stop as desired at block 623. Such stop may normally occur by way of the pump and motor controlling the stop, but it is also contemplated that one or more valves (such as, for example, the load holding valve 170, 370, 470) may also be involved in the deceleration.

Then, the load holding valve may be commanded closed at block 624.

At block 625 a timer is started to keep track of time elapsed since the valve was commanded close.

At block 626, the residual electric machine torque may be continuously or intermittently monitored, while the pressure between closed load holding valve and pump is expected to decay due to pump leakage. This torque may be monitored as an indicator of this line pressure, although a direct pressure measurement may be used in addition to or alternatively to the torque measurement. A pressure transducer directly measuring this pressure may provide for redundant measurement of this value.

At block 627, the value of the timer within each time step may be compared against a pre-established TimeOut value. This value may be a fixed or manually or automatically adjustable value based on various factors such as line size, pump type, fluid contamination, fluid temperature, pump wear, and/or the like. Typical lengths for this value may preferably be in the 1-10 second range, and may be preferably about 5 seconds.

As long as the TimeOut is not reached, another decision block 628 evaluates if electric machine torque has decreased below a pre-established torque threshold. Again, this prescribed criterion may be a fixed or manually or automatically adjustable value. For example, a pressure may also be measured between the actuator and the load holding valve in hydraulic line 316, 416, and this pressure value may be compared with the electric machine torque. This comparison may increase reaction time because the alternative of using a fixed value may require a value that is very low so as to capture all or most instances.

If the prescribed criteria is not met, the timer may be incremented at block 629 and the routine may continue in the loop as shown. If the electric machine torque has decreased below the prescribed criteria, it may be concluded that the load holding valve is closed, as desired, and valve status "OK" may be reported via block 630.

The routine may then end at block 633.

If block 627 recognizes that the timer value matches or exceeds TimeOut, it may cause block 631 to report a valve failure, which could then warn the operator of this failure.

Optionally, a predefined routine 632 may then ensure that the load is safely lowered, for example, by operating the electric machine and pump to lower the load. Once accomplished, the routine may end at block 633.

An optional fail-safe routine at block 632 may be to provide a second, back-up valve (such as a load holding valve) to either hold the load or to lower the load in a controlled manner.

Another alternative to increase the speed of the detection may include actively controlling the pump/motor to relieve the pressure between the load holding valve and pump as soon as the valve is commanded close at or around, for example, block 624. This can be achieved, for example, by allowing the motor-pump to back-spin a certain amount of time or a certain number of revolutions.

Another means of speeding this detection may include, as shown in FIG. 5 above, adding a small bleed valve to hose and draining that hydraulic line by opening the bleed valve as soon as the valve is commanded closed, for example at or around block 624. It is further contemplated that the valve can be on/off, proportional or any other technology that achieves the desired results by one having ordinary skill in the art.

Exemplary methods can be used to detect valve functionality when stopping a retraction or extension (lowering or lifting) motion. In general, it is most suitable when load forces are such that a certain amount of pressure remains in the cylinder after the load holding valve is closed, for example, when the actuator is acted upon by an outside force. The method can also be used on machine functions controlled by valves other than load holding valves.

While for purposes of simplicity of explanation, the illustrated method is shown and described above as a series of blocks, it is to be appreciated that the method is not limited by the order of the blocks, as some blocks can occur in different orders or concurrently with other blocks from that shown or described. Moreover, less than all the illustrated blocks may be required to implement an example methodology. Furthermore, additional or alternative methodologies can employ additional, not illustrated blocks.

In the flow diagram, blocks denote "processing blocks" that may be implemented with logic. The processing blocks may represent a method step or an apparatus element for performing the method step. A flow diagram does not depict syntax for any particular programming language, methodology, or style (e.g., procedural, object-oriented). Rather, a flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown or that blocks may be combined or separated into multiple components. It will be appreciated that the processes may be implemented using various programming approaches like machine language, procedural, object oriented or artificial intelligence techniques.

In one example, methodologies are implemented as processor executable instructions or operations provided on a computer-readable medium. Thus, in one example, a computer-readable medium may store processor executable instructions operable to perform a method.

While FIG. 6 illustrates various actions occurring in serial, it is to be appreciated that various actions illustrated in FIG. 6 could occur substantially in parallel.

"Logic," as used herein, includes but is not limited to hardware, firmware, software or combinations of each to perform a function(s) or an action(s), or to cause a function or action from another logic, method, or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

"Software," as used herein, includes but is not limited to, one or more computer or processor instructions that can be read, interpreted, compiled, or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software may also be implemented in a variety of executable or loadable forms including, but not limited to, a stand-alone program, a function call (local or remote), a servelet, an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or executable instructions can be located in one logic or distributed between two or more communicating, co-operating, or parallel processing logics and thus can be loaded or executed in serial, parallel, massively parallel and other manners.

Suitable software for implementing the various components of the example systems and methods described herein may be produced using programming languages and tools like Java, Java Script, Java.NET, ASP.NET, VB.NET, Cocoa, Pascal, C#, C++, C, CGI, Perl, SQL, APIs, SDKs, assembly, firmware, microcode, or other languages and tools. Software, whether an entire system or a component of a system, may be embodied as an article of manufacture and maintained or provided as part of a computer-readable medium.

Algorithmic descriptions and representations used herein are the means used by those skilled in the art to convey the substance of their work to others. An algorithm or method is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic system comprising:

a controller connected to an operator interface;

a pump operable in a first direction for supplying pressurized fluid;

a load-holding valve connected between the pump and a port for connection to an actuator, the load-holding valve controlled by the controller and operative in a first position to allow flow to the actuator to operate the actuator against a load and operative in a second position to block load-induced return flow from the actuator to the pump; and an electric machine configured to operate the pump;

wherein the controller is configured to receive a requested actuator stop, to control the load-holding valve to move to the second position in response to the requested actuator stop, to monitor a system condition in response to the requested actuator stop, to evaluate the monitored system condition with a prescribed criteria, and to determine whether or not to initiate a back-up control routine based on the evaluation; and wherein the monitored system condition is the electric machine's torque.

2. The hydraulic system of claim 1, wherein the back-up routine includes operating the pump to control load-induced movement of the actuator.

3. The hydraulic system of claim 1, wherein the controller is further configured to generate an alert indicating failure of the load-holding valve.

4. The hydraulic system of claim 1, wherein the controller is further configured to run the pump to depressurize hydraulic fluid between the pump and the load-holding valve after the load-holding valve is controlled to close.

5. The hydraulic system of claim 1, further comprising a second valve selectively fluidly connecting a hydraulic fluid passage between the pump and the load-holding valve to a reservoir, and wherein the controller is further configured to connect the hydraulic fluid passage to the reservoir after the load-holding valve is controlled to close.

6. The hydraulic system of claim 1, wherein the pump is a bi-directional pump operable in a first direction for supplying pressurized fluid through the load-holding valve to the actuator for operating the actuator in one direction, and operable in a second direction opposite the first direction for supplying pressurized fluid through a second valve to the actuator for operating the actuator in a direction opposite the first direction.

7. The hydraulic system of claim 1, further wherein the actuator is operable in opposite directions in response to hydraulic fluid being supplied to and returned from the actuator.

8. The hydraulic system of claim 1, further comprising:

a boost system for accepting fluid from or supplying fluid to a hydraulic circuit of the hydraulic system, wherein the boost system includes:

a boost pump for supplying fluid to a fluid make-up/return line that selectively is in fluid communication with the actuator, and a boost electric machine for driving the boost pump, the boost electric machine connected to a boost electric power source through a boost inverter.

9. The hydraulic system of claim 1, wherein the electric machine is an electric motor operated by the controller and connected to an electrical source through an inverter to drive the pump.

10. The hydraulic system of claim 1, wherein the monitored system condition further includes pressure between the pump and the load-holding valve.

11. A method of detecting a failure of hydraulic valve configured to control flow between a pump and an actuator in a hydraulic system, the method comprising the steps of:

receiving a requested stop of the actuator;

controlling the valve to close in response to the requested stop of the actuator;

monitoring a system condition in response to the requested stop of the actuator;

evaluating the monitored system condition with a prescribed criteria; and determining whether or not the valve has failed based on the evaluation;

wherein an electric machine operates the pump; and wherein the monitoring a system condition includes monitoring the electric machine's torque.

12. The method of claim 11, further comprising:

determining whether or not to operate the pump to stop the actuator based on the evaluation.

13. The method of claim 11, wherein the monitoring a system condition further includes monitoring pressure between the pump and the valve.

14. The method of claim 11, further comprising operating the pump to reduce pressure between the pump and the hydraulic valve after the controlling.

15. The method of claim 11, further comprising opening a bleed valve to reduce pressure between the pump and the hydraulic valve after the controlling.

16. The method of claim 11, further comprising:

operating the pump in one direction for supplying pressurized fluid through the valve to the actuator for operating the actuator in a first direction, and operating the pump in a second direction opposite the first direction for supplying pressurized fluid through a second valve to the actuator for operating the actuator in a direction opposite the first direction.

17. The method of claim 11, further comprising:

driving the pump via the electric machine connected to an electrical source through an inverter.

18. The method of claim 11, further comprising:

generating an alert indicating failure of the hydraulic valve based on the determination.

* * * * *